United States Patent [19]

Adachi

[11] Patent Number: 4,932,234

[45] Date of Patent: Jun. 12, 1990

[54] METHOD OF FORMING TAPPET ADJUSTING SCREWS

[75] Inventor: Shigemitu Adachi, Aichi, Japan

[73] Assignee: Tokai TRW & Co., Ltd., Japan

[21] Appl. No.: 346,407

[22] Filed: May 2, 1989

[30] Foreign Application Priority Data

May 14, 1988 [JP] Japan ..... 63-117991

[51] Int. Cl.[5] ..... B21D 53/00; B23G 1/00; B21J 5/02

[52] U.S. Cl. ..... 72/356; 10/10 R; 10/27 PH

[58] Field of Search ..... 10/3, 5, 7, 10 R, 27 R, 10/27 PH; 72/352, 354, 356, 358, 359, 360

[56] References Cited

U.S. PATENT DOCUMENTS 1,555,925 10/1925 Maurer ..... 10/27 R
1,851,127 3/1932 Moore et al. ..... 10/10 R
1,896,837 2/1933 Campbell et al. ..... 10/27 R
2,016,239 10/1935 Ford et al. ..... 10/27 PH
2,813,279 11/1957 Friedman ..... 10/27 PH
3,477,075 11/1969 Putetti ..... 10/10 R

FOREIGN PATENT DOCUMENTS 182956 3/1963 Sweden ..... 10/27 R

*Primary Examiner*—E. Michael Combs
*Attorney, Agent, or Firm*—Tarolli, Sundheim & Covell

[57] ABSTRACT

A method of forming a tappet adjusting screw is disclosed herein. In this method, a wire material is cut to a predetermined length, the cut flaws at one end of the material are removed and simultaneously the end face of the other end of the material is provided with a linear groove. The end face of the first end of the material is processed to a convex spherical shape and this end of the material is reduced in diameter and a flange is formed about the convex spherical end face, this flange then being sheared off.

10 Claims, 4 Drawing Sheets

METHOD OF FORMING TAPPET ADJUSTING SCREWSBACKGROUND OF THE INVENTION

This invention relates to a method of cold forging tappet adjusting screws adapted to allow adjustment of the valve clearance in the valve train of an automobile engine.

PRIOR ARTS

Several methods of forming tappet adjusting screws have been employed in the past. First of all, the shape of a complete tappet adjusting screw will be described and then a description of the prior arts relating to methods of forming tappet adjusting screws will be given.

Referring to FIG. 14, the tappet adjusting screw 10 is a columnar bar member the opposite ends of which are reduced in diameter and the peripheral surface of the intermediate larger diameter portion thereof between the opposite ends of the screw is threaded. This screw has a linear groove 12 formed at one end for receiving a screw driver and the other end of the screw has a convex spherical face 13.

Prior art methods for forming such mechanical parts include (1) the double blow header method and (2) the multistage first method.

The first method comprises such steps as a heading step in which the opposite ends of a wire material are squeezed, a cutting step in which one end of the wire material is given a linear groove 12 and the other wire end is given a convex spherical face 13, a center aligning step in which the intermediate portion between the opposite ends of the wire material is rolled to form a uniform diameter preparatory to threading, a step in which the peripheral surface of the intermediate portion is threaded, a heat-treatment step, and a buffing step in which the rough convex spherical face 13 is made smooth.

The latter method is similar to the first except that the heading and cutting steps are performed simultaneously.

However, the above-mentioned prior art methods present the problem that a large number of steps are involved resulting in high cost and a lengthy production process.

SUMMARY OF THE INVENTION

Thus, the present invention is directed to a method of forming tappet adjusting screws which involves a relatively small number of steps and is capable of producing end products with ease and precision.

In order to achieve this object, the present invention provides a method of forming tappet adjusting screws which comprises a first step in which a wire material processed to a uniform diameter by an elongating die is cut to a predetermined length, a second step in which the cut flaws at one end of the wire material are removed by a striking or pressing action and the other end of the wire material is given a linear groove, a third step in which the first end of the wire material is processed to give it a convex spherical face, a fourth step in which the convex spherical face is sheared off to reduce the diameter thereof and to thereby form a flange about the end, and a fifth step in which the reduced diameter spherical face is punched to remove the flange portion.

The above and other objects and attendant advantages of the present invention will became more readily apparent to those skilled in the art from reading the following detailed description in conjunction with the accompanying drawings which show one preferred embodiment of the present invention for illustration purposes only, and not for limiting the scope of the invention.

BRIEF DESCRIPTION OF THE DRAWINGS

FIGS. 1 to 13 inclusive show one preferred embodiment of the present invention wherein:

FIG. 1 is a schematic view showing the wire cutting step in the method of the present invention;

FIG. 2 is a side view of wire material after the cutting step;

FIG. 3 is a schematic view of a device in which the second step of the method of the invention is performed;

FIG. 4 is a partially broken-away fragmentary view of a portion of the device shown in FIG. 3;

FIG. 5 is a side view of wire material after the second step;

FIG. 6 is a schematic view of a device in which the third step of the method of the invention is performed;

FIG. 7 is a fragmentary view of a portion of the device shown in FIG. 6;

FIG. 8 is a side view of wire material after the third step;

FIG. 9 is a schematic view of a device in which a part of the fourth step of the method of the invention is performed;

FIG. 10 is a fragmentary view in partial section of a portion of the device shown in FIG. 9;

FIG. 11 is a side view of the wire material after the above mentioned part of the fourth step has been completed;

FIG. 12 is a schematic view of a device in which the fifth step of the method of the invention is performed;

FIG. 13 is a side view of wire material after the fifth step; and

PREFERRED EMBODIMENT OF THE INVENTION

The present invention will now be described referring to the accompanying drawings in which one preferred embodiment of the invention is illustrated. FIGS. 1 to 13 inclusive show one embodiment of the tappet adjusting screw forming method of the invention. As the preparatory step for the formation of a tappet adjusting screw, a length of wire which comprises the basic material of the tappet adjusting screw is straightened by means of a die (not shown) which makes the diameter of the wire material uniform throughout its length. This allows the diameter of the wire material (0.02 mm) to be secured so that a thread can be properly formed. Consequently the center alignment step that has hitherto been required can be eliminated.

Figure 1:
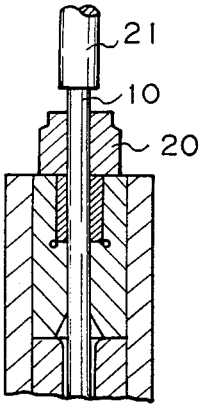
Figure 2:
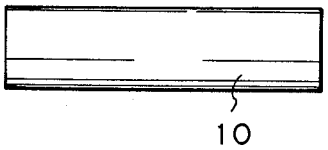

The wire material which now has a uniform diameter (shown by reference numeral 10 in FIG. 1) is processed to form a columnar bar, as shown in FIG. 2, having a predetermined length using a cutting device.

In FIG. 1, reference numeral 20 shows a cutter, reference numeral 20' denotes a shear die and reference numeral 21 denotes a stock gauge.

Figure 4:
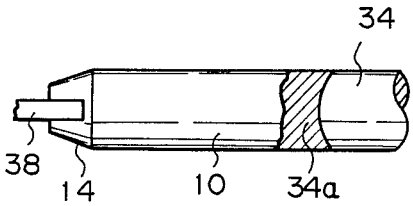
Figure 3:
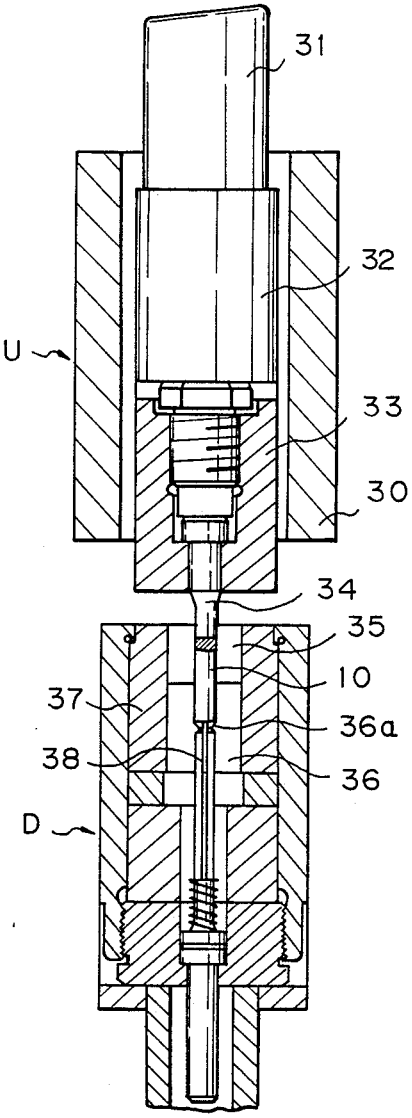
Figure 5:
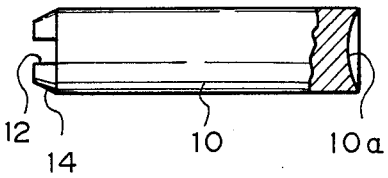

FIGS. 3–5 inclusive show the second step in the method of the present invention in which the cut wire material 10 is pressed at one end to form a linear groove at the other end thereof.

The device or press shown in FIG. 3 comprises a first die U (the die will be referred to as "upper U" hereinafter) provided on a punch holder 30 which is in turn fixedly secured to a ram and a fixed second die D (the die will be referred to as "lower die D" hereinafter).

The upper die U comprises a shank 31 interlocked with a drive mechanism (not shown), a punch board 32, a punch holder 33 and a punch 34 fixedly secured to the punch holder 33.

The lower die D comprises a first die member 35, a second die member 36 disposed adjacent to the first die 35 and having a through hole of circular cross-section provided with a tapered reduced diameter area 36*a* in an intermediate section between the upper and lower ends thereof, a die case 37 for holding the upper die U, and a linear groove cutting member 38 that is inserted in the through hole in the second die member 36 from below and brought up to the reduced diameter area 36*a* for the purpose of forming a groove at one end of the wire material.

As more clearly shown in FIG. 4, the leading end of the punch 34 is formed with a convex spherical face 34*a* which is adapted to press the columnar wire material 10 set in the holes in the dice 35, 36 at the front end 10*a* of the wire material to form a concave spherical groove and to thereby remove the flaws created by the cut at the end of the wire material.

As a result of the processing of the wire material end on being pressed by the punch 34, the rear end of the work 10 is forced into the reduced diameter area of the through hole in the second die member 36 whereby a taper 14 is formed at the rear end of the wire material 10, as shown in FIGS. 4 and 5, and at the same time, a linear groove 12 is formed by the linear groove cutting member 38 at the same end of the wire material, i.e., the opposite end relative to the concave spherical end 10*a* of the wire material.

At the completion of the second step, the wire material 10 presents the shape shown in FIG. 5.

Next, the third step of the method of the present invention will now be described referring to FIGS. 6–8, in which the end face 10*a* of the wire material 10 as shown in FIG. 5 is formed into a convex spherical shape while the end face is to a certain degree kept in a rough state.

Since the convex spherical end face of the wire material 10 formed in the third step is adapted to abut against another mechanical part, whereby the convex end face serves as a sizing means, the wire end is required to have a predetermined spherical face roughness (less than 3.2 S, for example).

Thus, in the third step, the convex spherical end face of the wire material is formed by the employment of a concave spherical face die having an air hole at the top.

Figure 6:
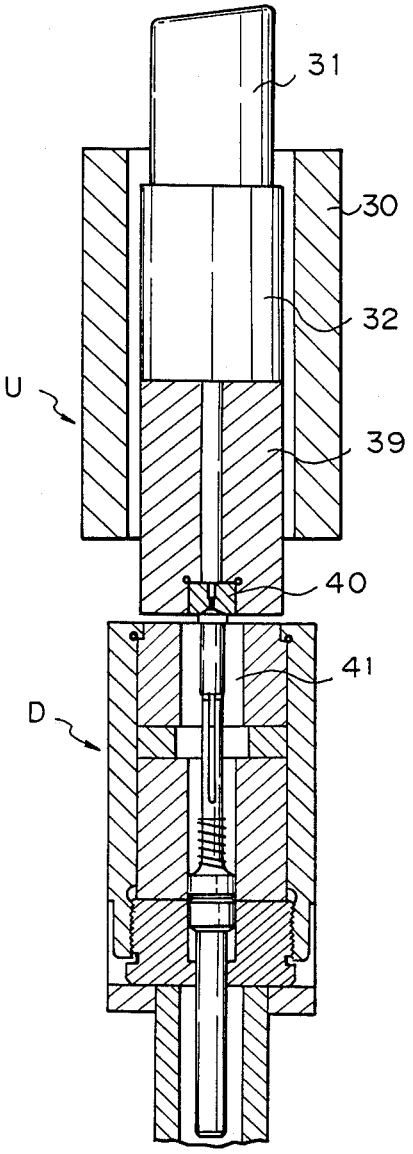

FIG. 6 shows a press similar to that shown in FIG. 3. This press comprises an upper die U including a shank 31, a punch 40, and a lower die D comprising a die member 41 fitting on the work 10 with one end of the work projecting out of the die member.

Figure 7:
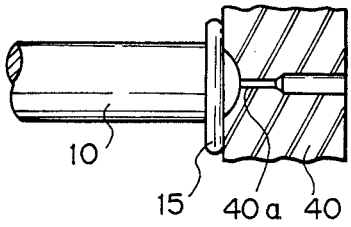

As shown on an enlarged scale in FIG. 7, the punch 40 is shown as having an air hole 40*a* formed at the top, but if no air hole 40*a* is provided, there is a tendency for a flat area to remain at the processed convex spherical end face 13 of the wire material after the formation of the spherical face 13.

Assuming that the spherical face 13 has a value for R of 15.7 mm and the roughness of the spherical face is less than 3.2 S, a suitable diameter for the air hole 40*a* is in the range of 0.2–0.4 mm.

When the convex face 13 is formed in the step described above, a grinding step consisting of such work as buffing can be eliminated.

Figure 8:
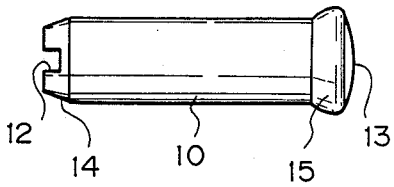

After the third step has been conducted in the method of the present invention, the wire material 10 presents the shape shown in FIG. 8. In the formation of the convex spherical face 13, a flange 15 is simultaneously formed about the convex spherical face.

Figure 9:
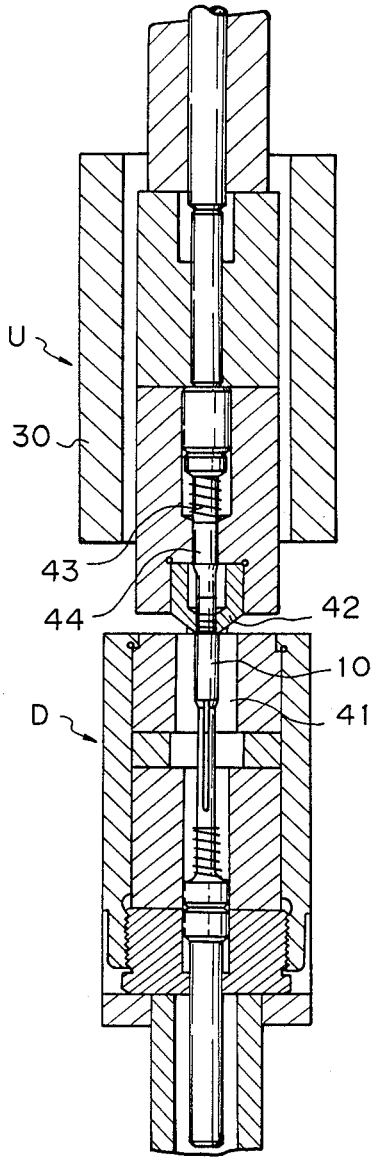

FIG. 9 shows a press used in performing the fourth step of the method of the present invention, in which the convex spherical face 13 of the wire material 10 formed in the third step is subjected to a shearing process so as to reduce the diameter of the face 13. The lower die D in the press of FIG. 9 is identical to the corresponding part in the press shown in FIG. 6.

In the press of FIG. 9, the upper die U comprises a shank 31, a punch board 32, a punch case 33, a punch 42 having an annular cutting blade 42*a* at the leading end thereof and a knock-out 44 adapted to advance from and be retracted into the center opening in the punch 42 under the downward force of a knock spring 43.

When the squeezing step is conducted to reduce the diameter of the convex spherical face 13, the shape of the convex spherical face 13 tends to deform to such a degree that the spherical face cannot maintain a constant value for R. In order to eliminate the difficulty inherent in this squeezing step, a shearing step is employed in the present invention.

In this shearing step, the wire material 10 is set in the die member 41 and the upper die U is then advanced.

Figure 10:
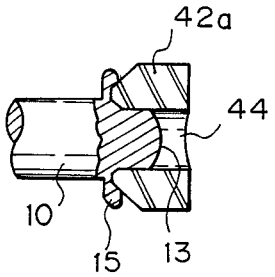

When the leading end of the cutting blade 42*a* abuts against the convex spherical face 13 as the upper die U advances, the knock-out 44 assumes a position in which it does not directly contact the convex spherical face 13. And as the upper die U advances, as shown in FIG. 10, the cutting blade 42*a* expands the material of the convex spherical face 13 radially outwardly to form the flange 15 while cutting the face, and the knock-out 44 then kicks the wire material 10 out of the die member 41.

Figure 11:
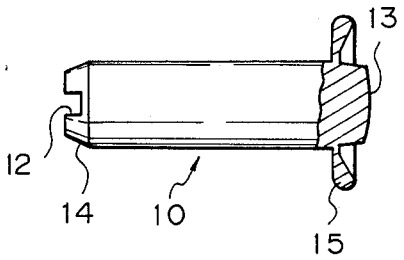

FIG. 11 shows the wire material 10 after the fourth step.

Figure 12:
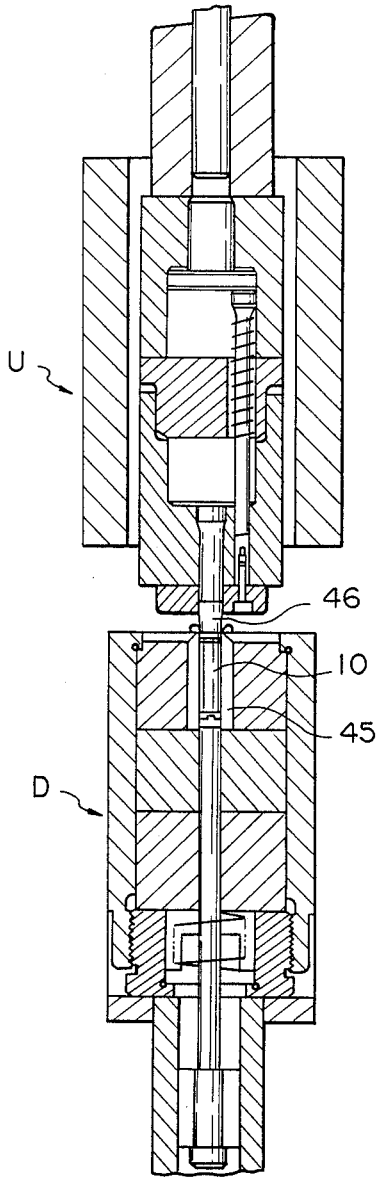

Thereafter, the flange 15 of the wire material 10 which has been expanded by the press shown in FIG. 12 is sheared, thereby completing the fifth step of the method according to the present invention.

The press of FIG. 12 includes a die 45 having a hole of circular cross-section and a punch 46 adapted to fit in the hole in the die 45. The wire material 10 shown in FIG. 11 is set in the die 45 and the punch 46 then shears off the flange 15 formed about the convex spherical face 13.

The shearing step reduces the diameter of the convex spherical face 13 without deforming the convex spherical face 13.

Figure 13:
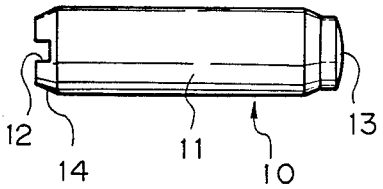
Figure 14:
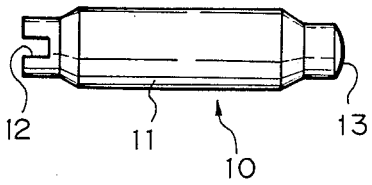
FIG. 14 is a side view of a complete tappet adjusting screw.

After the fifth step, the wire material 10 presents the shape shown in FIG. 13.

Thereafter, the larger diameter intermediate portion 11 of the wire material 10 is rolled so that a thread is formed thereon, but since the diameter of the wire portion 11 has been made uniform throughout its length by the elongation process, this thread formation can be achieved without any need for a center aligning step.

Tappet adjusting screws can be rapidly and precisely produced employing the steps of the method according to the present invention.

As described hereinabove, according to the method of the present invention, the wire end face can be made uniform by the striking step and the size and roughness of the end face can be maintained within predetermined ranges without any need for a grinding step such as buffing.

While one preferred embodiment of the invention has been illustrated and described in detail, it will be understood that the same is presented for illustration purposes only and is not to be taken as a definition of the scope of the invention, which scope is defined only by the appended claims.

What is claimed is:

1. A method for forming a tappet adjusting screw comprising:

a first step of forming a blank having a diameter and an intermediate portion between opposed end faces by cutting a wire material to a predetermined length;

a second step of removing flaws presented on one end face of said blank by striking or pressing said one end face and simultaneously forming a tool engaging groove on said other end face of said blank;

a third step of processing said one end face of said blank to provide a convex spherical face by a concave spherical face die;

a fourth step of reducing the diameter of said one end of said blank with said convex spherical end face to a size less than said blank diameter by shearing a peripheral portion of said convex spherical face to thereby simultaneously form a flange around the reduced diameter end; and a fifth step of shearing off said flange.

2. A method of forming a tappet adjusting screw as set forth in claim 5 wherein said fourth step is performed by causing a cutting blade to abut against said convex spherical face.

3. A method of forming a tappet adjusting screw as set forth in claim 5 wherein said fifth step is performed by punching off said flange.

4. A method for forming a tappet adjusting screw as set forth in claim 5 wherein, after said fifth step has been performed, said intermediate portion between said ends of said blank is provided with a thread.

5. A method of forming a tappet adjusting screw comprising the steps of:

(a) providing a wire blank having a first end with a first end face, an intermediate portion, and a second end with a second end face and a given diameter;

(b) providing means for engagement by a tool at said first end face;

(c) forming a convex end surface at said second end face with a formed diameter less than said given diameter;

(d) forming a peripheral flange around said convex surface; and, (e) removing said flange.

6. A method as defined in claim 5 wherein said step of forming said convex end surface includes the step of pressing said second end face in a die having a concave surface portion, and the further step of pressing said second end face against an annular cutting blade having a diameter less than said given diameter.

7. A method as defined in claim 6 wherein said flange is formed simultaneously with said formation of said convex end surface.

8. A method as defined in claim 7 wherein said flange is first formed when said second end face is pressed in said die, and is further formed when said second end face is pressed against said cutting blade.

9. A method as defined in claim 6 wherein said flange is removed by pressing said flange against a die having a cutting edge at an open end facing away from said first end of said blank.

10. A method as defined in claim 9 further comprising the step of providing threads at said intermediate portion of said blank.

* * * * *

UNITED STATES PATENT AND TRADEMARK OFFICE

CERTIFICATE OF CORRECTION

PATENT NO. : 4,932,234

DATED : June 12, 1990

INVENTOR(S) : Shigemitu Adachi

It is certified that error appears in the above-identified patent and that said Letters Patent is hereby corrected as shown below:

Column 5, Line 39, Claim 2, change "5" to --1--.

Column 6, Line 2, Claim 3, change "5" to --1--.

Signed and Sealed this

Sixteenth Day of July, 1991

*Attest:*

HARRY F. MANBECK, JR.

*Attesting Officer*

*Commissioner of Patents and Trademarks*